US007025632B2

(12) United States Patent
Hu et al.

(10) Patent No.: US 7,025,632 B2
(45) Date of Patent: Apr. 11, 2006

(54) ELECTRICAL CONNECTOR WITH IMPROVED SPACER

(75) Inventors: Jinkui Hu, Kunsan (CN); Guohua Zhang, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/890,086

(22) Filed: Jul. 12, 2004

(65) Prior Publication Data

US 2005/0009401 A1 Jan. 13, 2005

(30) Foreign Application Priority Data

Jul. 11, 2003 (TW) ..... 92212812 U

(51) Int. Cl.
*H01R 13/58* (2006.01)

(52) U.S. Cl. ..... 439/606; 439/607

(58) Field of Classification Search ..... 439/606, 439/607

See application file for complete search history.

(56) References Cited

U.S. PATENT DOCUMENTS

| | | | | |
|---|---|---|---|---|
| 6,120,321 | A | 9/2000 | Wu | |
| 6,155,872 | A | 12/2000 | Wu | |
| 6,162,089 | A | 12/2000 | Costello et al. | |
| 6,210,218 | B1 * | 4/2001 | Chang | 439/567 |
| 6,315,608 | B1 | 11/2001 | Lopata et al. | |
| 6,685,486 | B1 * | 2/2004 | Zhang et al. | 439/79 |
| 6,814,612 | B1 * | 11/2004 | Hu et al. | 439/541.5 |

* cited by examiner

*Primary Examiner*—Ross Gushi
(74) *Attorney, Agent, or Firm*—Wei Te Chung

(57) ABSTRACT

An electrical connector (1) includes a dielectric housing (12), a number of first and second terminals (20, 30) received in the dielectric housing respectively and a spacer (25) assembled onto the dielectric housing. Each terminal comprises a contact portion (22, 32) adapted for engaging with a complementary connector and an intermediate portion (21, 31) extending from the contact portion. The intermediate portion (21) of the first terminal is insert-molded in the spacer. The intermediate portion (31) of the second terminal is sandwiched between the dielectric housing and the spacer.

12 Claims, 8 Drawing Sheets

ELECTRICAL CONNECTOR WITH IMPROVED SPACER

CROSS-REFERENCE TO RELATED APPLICATIONS

Relevant subject matter is disclosed in a pending U.S. patent application Ser. No. 10/631,566, filed on Jul. 30, 2003 and entitled "HIGH PROFILE ELECTRICAL CONNECTOR"(U4201), which is invented by the same inventors as this patent application and assigned to the same assignee with this application.

BACKGROUND OF THE INVENTION

1. Field of the Invention

The present invention relates to an electrical connector, and particularly to an electrical connector having a spacer.

2. Description of Related Art

With the development of communication and computer technology, electrical connectors for high-speed data transmission are widely used in electronic systems. IEEE1394 (Institute of Electrical and Electronics Engineers; IEEE) connectors are commonly used to connect external and internal peripheral devices to a computer for performing high speed data transmission therebetween. These connectors typically employ a plug connector terminated to a transmission cable and a receptacle connector mounted on a circuit board of the computer.

U.S. Pat. No. 6,315,608 discloses a receptacle connector comprising an insulative housing having a base portion and a mating portion, a plurality of conductive terminals retained in the housing, an inner shield enclosing the mating portion of the housing for electromagnetic interference protection, and an outer metal shield enclosing both the housing and the inner shield for further electromagnetic interference protection. In some special applications, a large distance is required between the mating portion and a printed circuit board (PCB) on which the receptacle connector is mounted. A high profile receptacle connector is accordingly developed to satisfy this requirment. However, the high profile receptacle connector may cause a variety of problem. For instance, as the complexity of the high profile housing increases, the difficulty of manufacturing the high profile housing increases. Another problem is that the terminals received in the high profile housing have elongated mounting potions, which results in that the elongated mounting portions are difficult to be positioned and therefore are inaccurately connected to the PCB.

U.S. Pat. Nos. 6,120,321 and 6,155,872 both disclose a stacked connector having a spacer. The spacer defines two rows of terminal receiving holes receiving corresponding terminals of the stacked connector therein. However, forming the two rows of the terminal receiving holes complicates the manufacture of the spacer. Furthermore, it is labourious to assemble the spacer onto the stacked connector due to the terminal receiving holes of the spacer.

Hence, an electrical connector having an improved spacer is desired to overcome the disadvantage of the prior art.

SUMMARY OF THE INVENTION

An object of the present invention is to provide an electrical connector with an improved spacer for facilitating positioning terminals of the connector.

To achieve the above object, an electrical connector in accordance with the present invention comprises a dielectric housing, a plurality of first and second terminals received in the dielectric housing respectively and a spacer assembled onto the dielectric housing. Each terminal comprises a contact portion adapted for engaging with a complementary connector and an intermediate portion extending from the contact portion. The intermediate portion of the first terminal is insert-molded in the spacer, the intermediate portion of the second terminal is sandwiched between the dielectric housing and the spacer.

Other objects, advantages and novel features of the invention will become more apparent from the following detailed description when taken in conjunction with the accompanying drawings.

DETAILED DESCRIPTION OF THE PREFERRED EMBODIMENT

Figure 1:
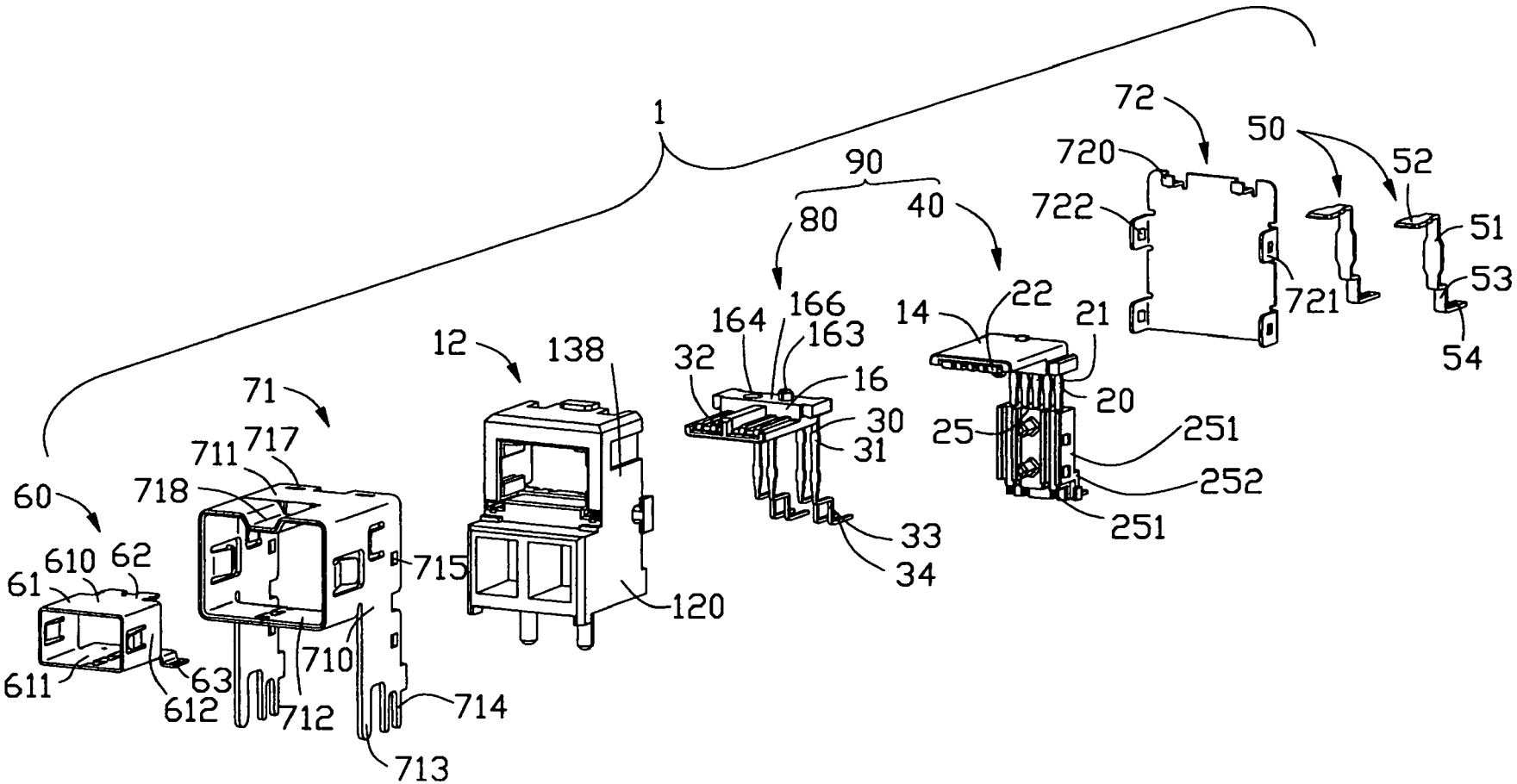
FIG. 1 is an exploded perspective view of an electrical connector in accordance with the present invention.
Figure 2:
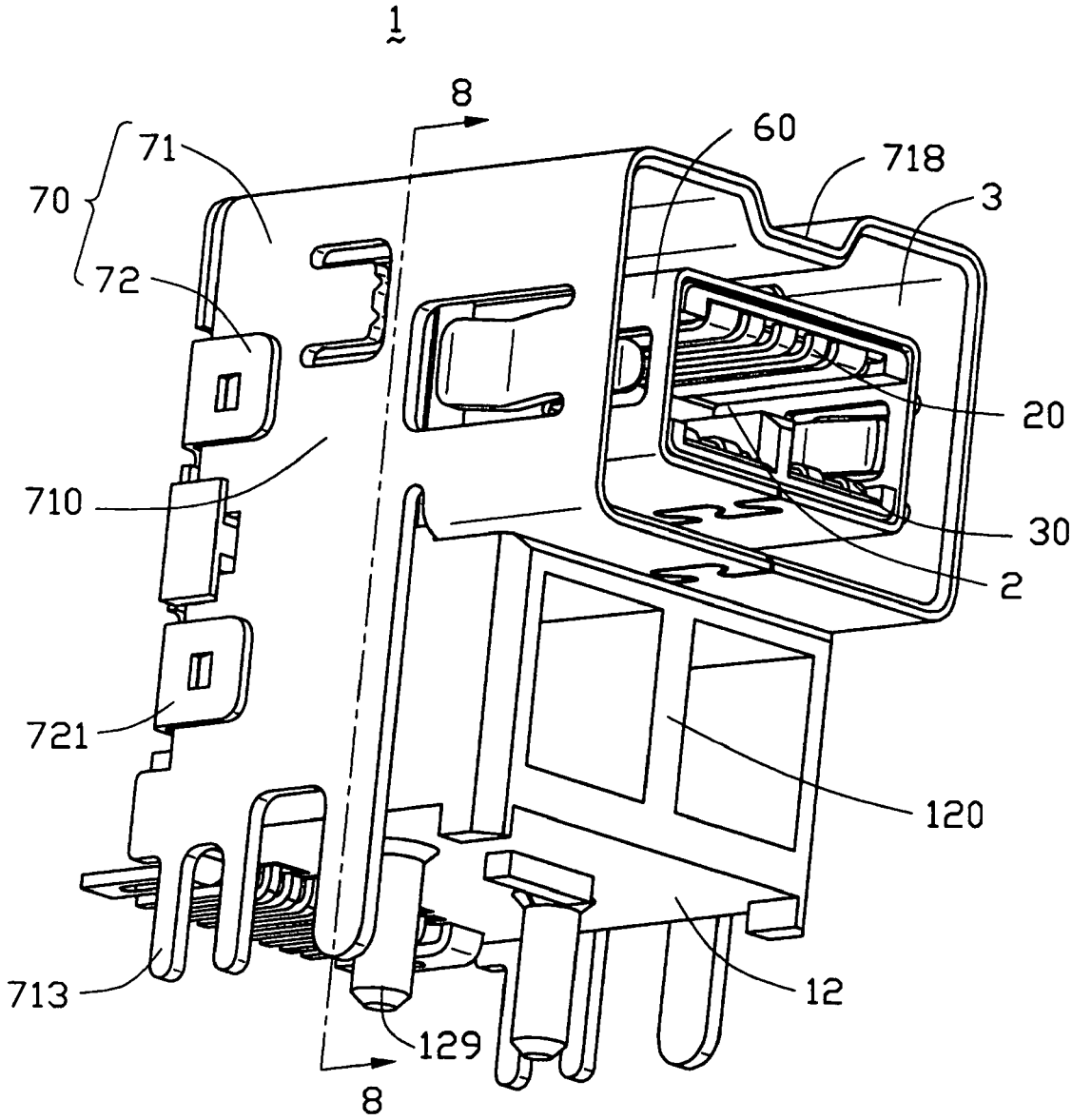
FIG. 2 is an assembled perspective view of the connector shown in FIG. 1.

Referring to FIGS. 1 and 2, an electrical connector 1 in accordance with the present invention comprises a dielectric housing 12, a terminal subassembly 90 received in the dielectric housing 12, an inner shield 60 enclosing the terminal subassembly 90, an outer shield 70 enclosing the dielectric housing 12 and a pair of grounding tabs 50 for electrically connecting with the inner shield 60.

Figure 3:
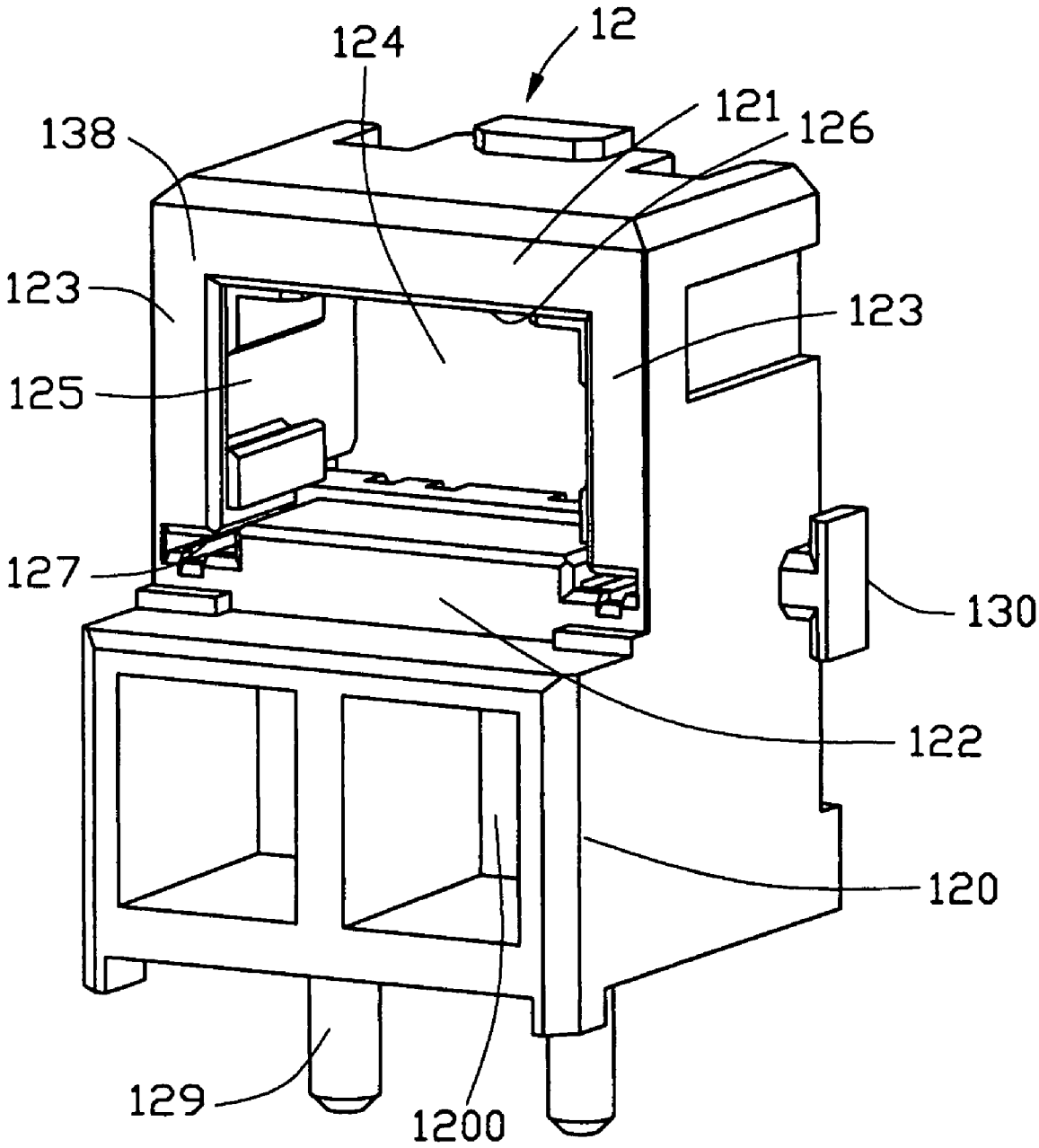
FIG. 3 is a front perspective view of a dielectric housing of the connector shown in FIG. 1.

Referring to FIG. 3, the dielectric housing 12 comprises a supporting portion 120 and a mating portion 138 located above the supporting portion 120. The supporting portion 120 defines a pair of chambers 1200 therein for saving material. A plurality of posts 129 extends downwardly from a bottom face of the supporting portion 120 for being received in corresponding holes of a printed circuit board (PCB, not shown) on which the connector 1 is mounted. The mating portion 138 comprises opposite upper and lower walls 121, 122 and a pair of opposite side walls 123 interconnecting the upper wall 121 with the lower wall 122. The upper wall 121, the lower wall 122 and the side walls 123 together define a receiving space 124 thereamong. Each side wall 123 defines a swallow-tailed groove 125 communicating with the receiving space 124 in an inner face thereof. The upper wall 121 defines a recess 126 communicating with the receiving space 124 in an inner face thereof. The mating portion 138 defines a pair of channels 127 communicating with the receiving space 124 at two junctures of the side walls 123 and the lower wall 122.

Figure 4:
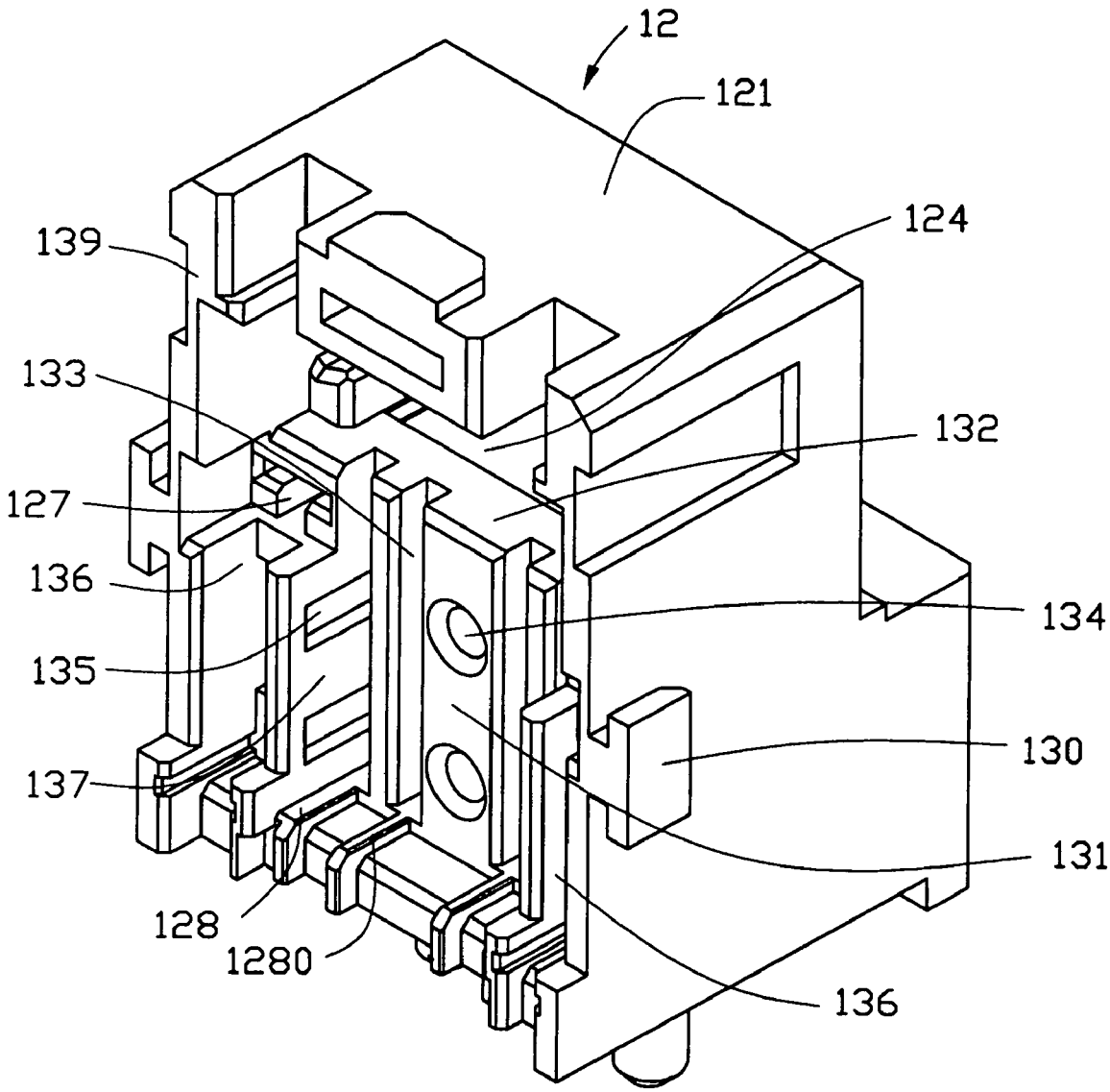
FIG. 4 is a rear perspective view of the dielectric housing shown in FIG. 3.
Figure 5:
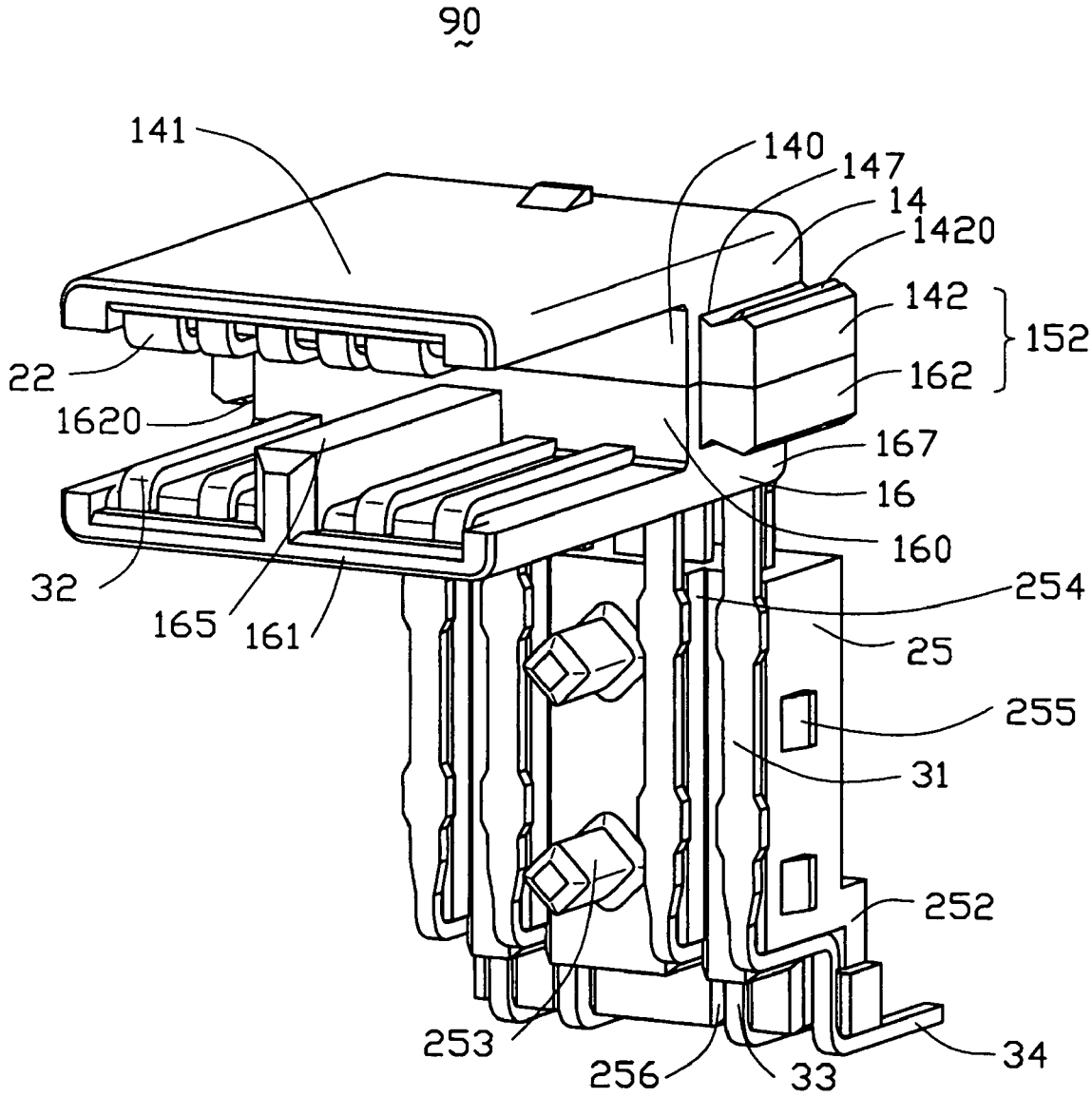
FIG. 5 is a perspective view of a terminal subassembly of the connector shown in FIG. 1.
Figure 6:
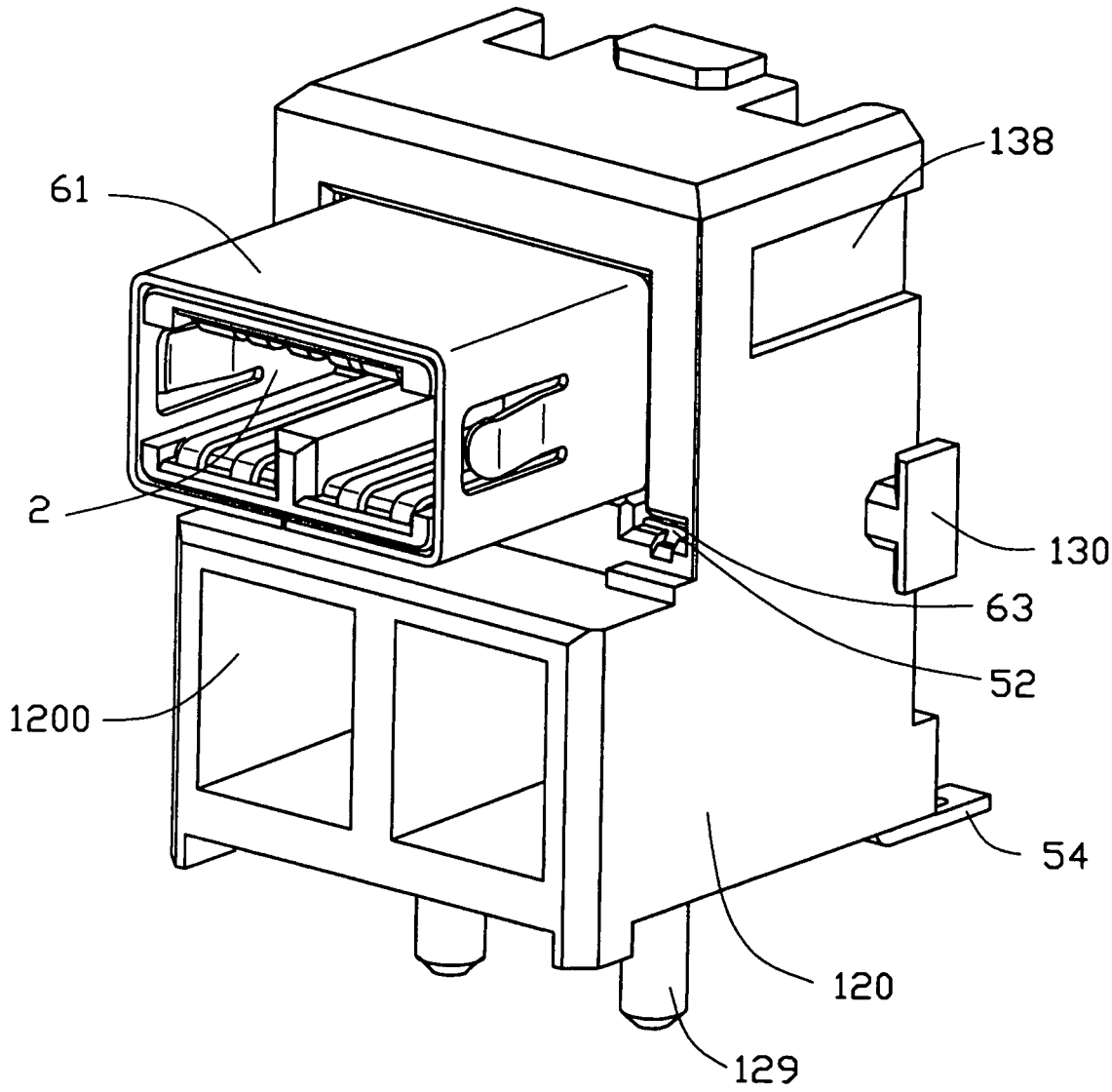
FIG. 6 is a front perspective view of the connector shown in FIG. 1, prior to assembly of an outer shield.
Figure 7:
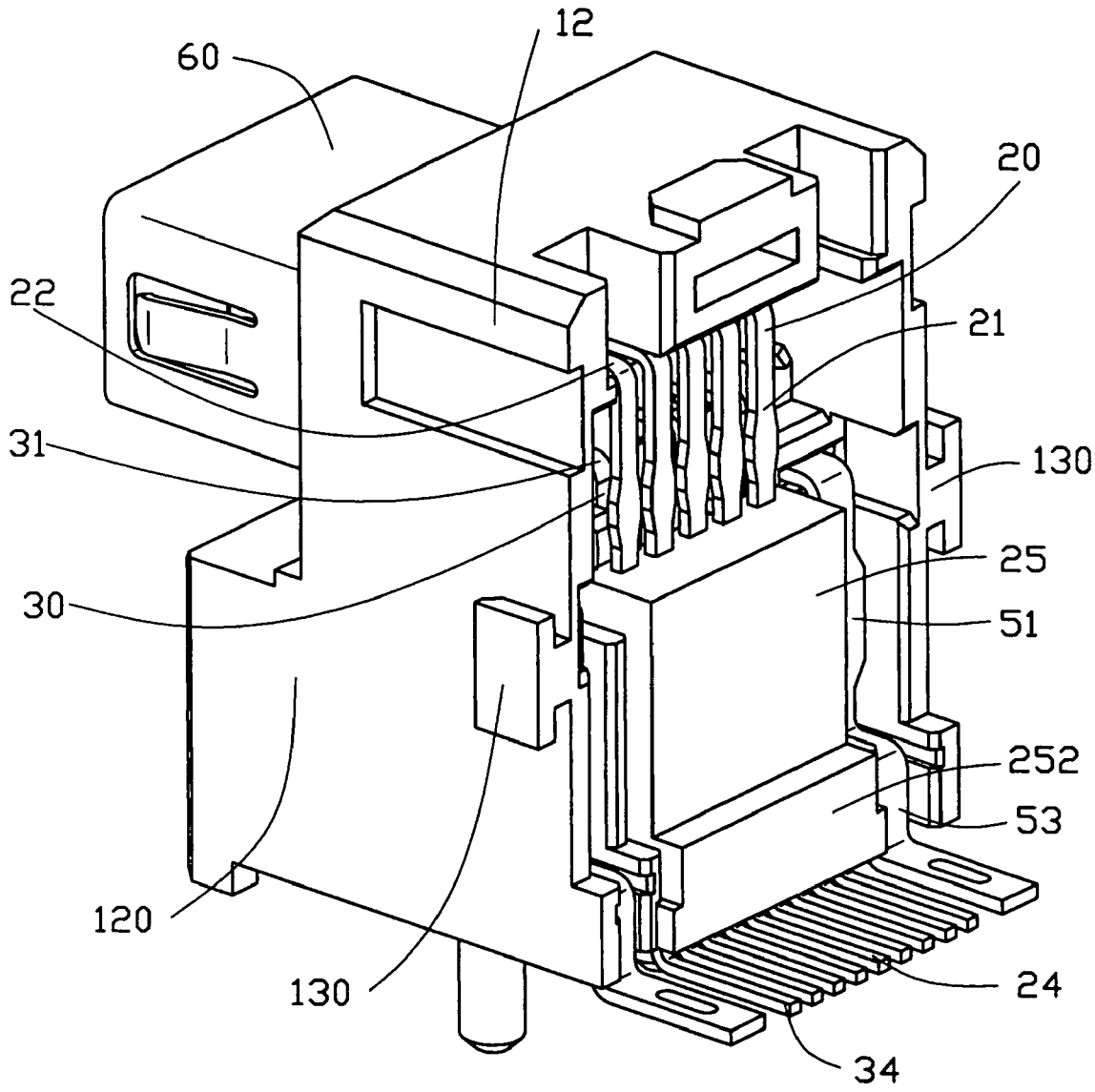
FIG. 7 is a view similar to FIG. 6 but taken from a different perspective.

Referring to FIG. 4, the dielectric housing 12 defines a cavity 131 communicating with the receiving space 124 in a rear face 139 thereof. An inside wall 132 of the cavity 131 defines a plurality of passageways 133 communicating with the receiving space 124 and a pair of holes 134 between the passageways 133. A plurality of notches 135 is defined in inner side faces 137 of the cavity 131. The dielectric housing 12 defines a pair of slots 136 communicating with the corresponding channels 127 at opposite ends of the rear face 139. The dielectric housing 12 comprises a first stepped portion 128 extending rearwardly from a lower end of the rear face 139 thereof. The first stepped portion 128 is formed with a plurality of bulges 1280 aligned with the corresponding passageways 133.

Figure 8:
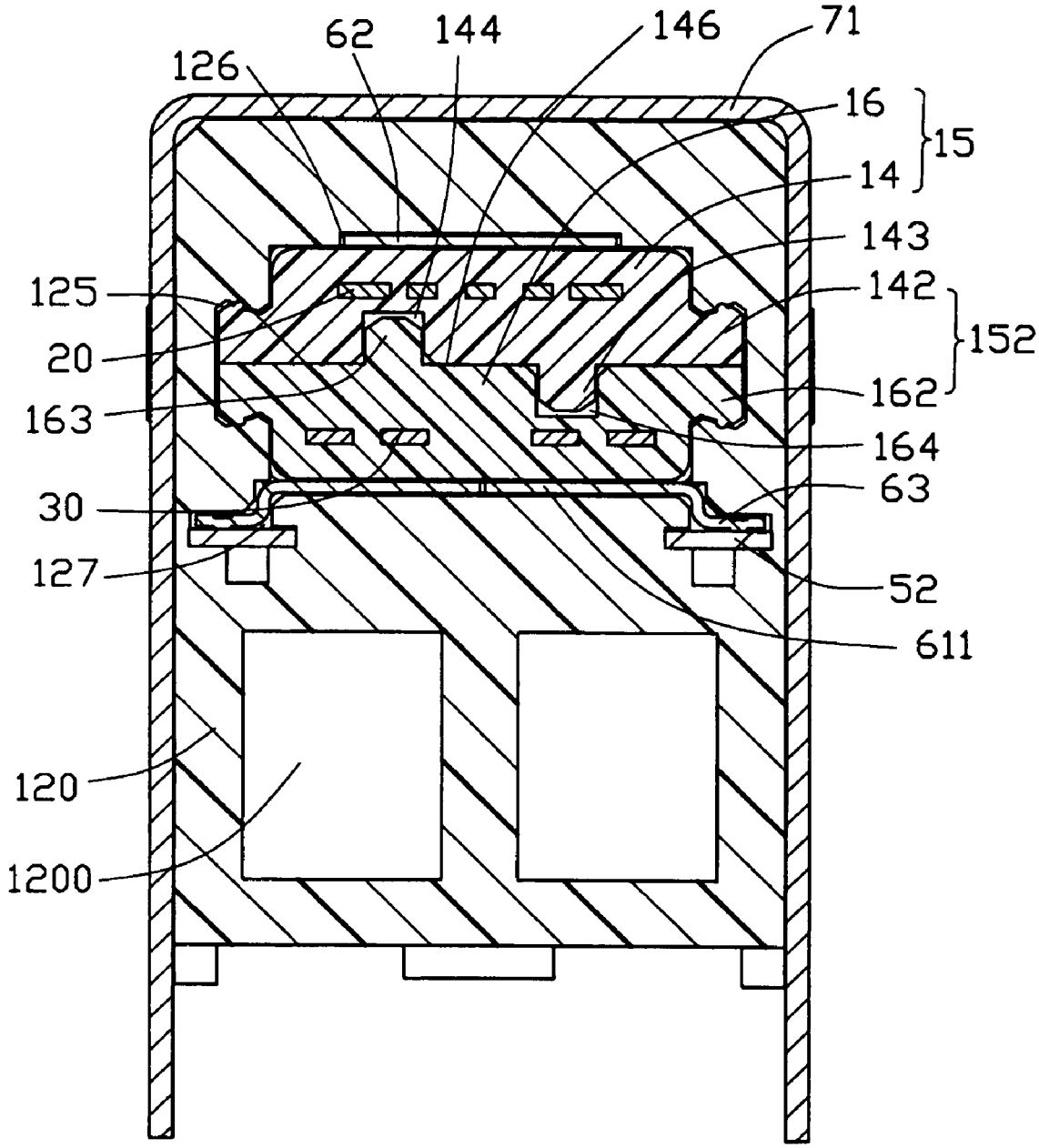
FIG. 8 is a cross-sectional view of the connector taken along line 8—8 in FIG. 2.

Referring back to FIG. 1, the terminal subassembly 90 comprises a first terminal module 40 and a second terminal module 80. The first terminal module 40 comprises a first dielectric body 14, a plurality of first terminals 20 partially retained in the first dielectric body 14 and a spacer 25 in which the first terminals 20 partially retained. The second terminal module 80 comprises a second dielectric body 16 and a plurality of second terminals 30 retained in the second dielectric body 16. The first and the second dielectric body 14, 16 form a dielectric body 15 (FIG. 8).

Referring to FIGS. 5, 6, 7 and 8, the first and the second dielectric bodies 14, 16 are stacked with each other. Each of the first and the second dielectric bodies 14, 16 comprises a base 140, 160 having an engaging face 146, 166 (FIG. 1) and a pair of opposite side faces 147, 167, and a tongue 141, 161 extending forwardly from a front face of the base 140, 160. Each base 140, 160 comprises a hole 144, 164 defined in the engaging face 146, 166 and a post 143, 163 formed on the engaging face 146, 166. The hole 144 and the post 143 of the base 140 of the first dielectric body 14 respectively engage with the corresponding post 163 and hole 164 of the base 160 of the second dielectric body 16 for securing the first and the second terminal modules 40, 80 together. The base 140 of the first dielectric body 14 and the base 160 of the second dielectric body 16 form a retaining member received in the receiving space 124 of the dielectric housing 12. Each base 140, 160 is formed with a pair of opposite projections 142, 162 on the opposite side faces 147, 167 thereof. Each projection 142, 162 is formed with a rib 1420, 1620 thereon. The projections 142 of the first dielectric body 14 and the corresponding projections 162 of the second dielectric body 16 form a pair of swallow-tailed protrusions 152 retained in the corresponding swallow-tailed grooves 125 of the dielectric housing 12 with the ribs 1420, 1620 interferentially engaging with inner faces of the grooves 125. The tongues 141, 161 are parallel to and vertically offset from each other and projected beyond a front face of the mating portion 138. The tongue 161 of the second dielectric body 16 is formed with a key 165 extending upwardly toward the tongue 141 of the first dielectric body 14 for ensuring a blind mating of a complementary connector.

Each of the first and second terminals 20, 30 comprises a vertical intermediate portion 21, 31, a contact portion 22, 32 extending forwardly from the intermediate portion 21, 31. The contact portion 22, 32 of the first and the second terminals 20, 30 are insert-molded in the base 140, 160 respectively and exposed on an inner face of the tongue 141, 161 of the first and the second dielectric bodies 40, 80. The first terminal 20 also comprises a solder tail 24 extending from the intermediate portion 21 for connecting with a corresponding pad of the PCB. The second terminal 30 also comprises a third stepped portion 33 extending from the intermediate portion 31 and a solder tail 34 extending from the third stepped portion 33 for connecting with a corresponding pad of the PCB.

The spacer 25 comprises a main portion 251 received in the cavity 131 of the dielectric housing 12 and a second stepped portion 252 engaging with the first stepped portion 128. The intermediate portions 21 of the first terminals 20 are partially insert-molded in the spacer 25. The main portion 251 is formed with a pair of posts 253, a plurality of ribs 254 on a front face thereof and a plurality of embossments 255 on opposite side faces thereof. The posts 253 of the main portion 251 are fit in the corresponding holes 134 of the inner wall 132 of the cavity 131. The embossments 255 engages with corresponding notches 135. The intermediate portions 31 of the second terminals 30 are snugly sandwiched between the corresponding ribs 254 of the main portion 251 and corresponding passageways 133 in the inner wall 132 of the dielectric housing 12. The second stepped portion 252 defines a plurality of cutouts 256 aligned with the ribs 254 of the main portion 251. The cutouts 256 and corresponding bulges 1280 engage with each other with the third stepped portions 33 of corresponding second terminals 30 sandwiched therebetween.

Referring back to FIGS. 1 and 2, the inner shield 60 and the outer shield 70 are stamped from metallic material. The inner shield 60 comprises a shroud 61 enclosing the tongues 141, 161 of the first and the second dielectric bodies 14, 16 and defining a first engaging space 2 therein, a retaining tab 62 extending rearwardly from an upper wall of the shroud 61 to be retained in the recess 126 of the dielectric housing 12, and a pair of grounding fingers 63 extending curvedly and laterally from opposite ends of a lower wall of the shroud 61 to be received in the corresponding channels 127 of the dielectric housing 12. Each grounding tab 50 comprises an intermediate portion 51 received in the corresponding slot 136 of the dielectric housing 12, a contact portion 52 extending forwardly from the intermediate portion 51 into the corresponding channel 127 and contacting with the grounding finger 63 and a solder tail 54 extending horizontally from the intermediate portion 51 for electrically connecting with a grounding pad of the PCB.

The outer shield 70 comprises a front shield 71 and a rear shield 72 both attached to the dielectric housing 12. The front shield 71 comprises a shroud 711 enclosing the shroud 61 of the inner shield 60 and the mating portion 138 of the dielectric housing 12, and a pair of opposite side walls 713 extending downwardly from the shroud 711 to cover side faces of the dielectric housing 12. The shroud 61 of the inner shield 60 and the shroud 711 of the front shield 71 together define a second engaging space 3 therebetween. Each side wall 713 is formed with a grounding tail 714 for connecting with the grounding path of the PCB. The side walls 713 and the shroud 711 define a plurality of openings 715 therein. The rear shield 72 covers the rear face 139 of the dielectric housing 12 and is formed with a plurality of tabs 720 engaging with the openings 715 of the front shield 71.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing;

a plurality of first and second terminals received in the dielectric housing, each terminal comprising a contact portion adapted for engaging with a complementary connector and an intermediate portion extending from the contact portion; and a spacer assembled onto the dielectric housing, the intermediate portions of the first terminals being insert-molded in the spacer, the intermediate portions of the second terminals being sandwiched between the dielectric housing and the spacer, wherein the dielectric housing defines a cavity receiving the spacer therein, and wherein the dielectric housing defines a plurality of passageways communicating with the cavity, and wherein the intermediate portion of the second terminal is received in a corresponding passageway.

2. The electrical connector as claimed in claim 1, wherein the spacer is formed with a plurality of ribs received in corresponding passageways.

3. The electrical connector as claimed in claim 1, wherein the dielectric housing defines a hole in the inside wall of the cavity, and wherein the spacer is formed with a post engaging with the hole of the dielectric housing.

4. The electrical connector as claimed in claim 1, wherein the dielectric housing defines a notch communicating with the cavity, and wherein the spacer is formed with an embossment engaging with the notch.

5. The electrical connector as claimed in claim 1, wherein the dielectric housing is formed with a first stepped portion and the spacer comprises a second stepped portion engaging with the first stepped portion, and wherein each second terminal comprises a third stepped portion extending from the intermediate portion and sandwiched between the first and the second stepped portion.

6. The electrical connector as claimed in claim 5, wherein the first stepped portion is formed with a plurality of bulges and the second stepped portion defines a plurality of cutouts receiving corresponding bulges and the third stepped portions of the second terminals therein.

7. An electrical connector comprising:

a dielectric housing;

a plurality of first and second terminals received in the dielectric housing, each terminal comprising a contact portion adapted for engaging with a complementary connector and an intermediate portion extending from the contact portion;

a spacer assembled onto the dielectric housing, the intermediate portions of the first terminals being insert-molded in the spacer, the intermediate portions of the second terminals being sandwiched between the dielectric housing and the spacer, and a first dielectric body insert-molding with the contact portions of the first terminals and a second dielectric body insert-molding with the contact portions of the second terminals, wherein the dielectric housing defines a receiving space receiving the first and the second dielectric bodies therein.

8. The electrical connector as claimed in claim 7, wherein the dielectric housing comprises a support portion and a mating portion extending upwardly from the support portion, and wherein the receiving space is defined in the mating portion.

9. The electrical connector as claimed in claim 8, further comprises an inner shield and an outer shield, the inner shield enclosing the first and the second dielectric bodies and defining a first engaging space therein, the outer shield enclosing the dielectric housing and the inner shield, the outer shield and the inner shield defining a second engaging space therebetween.

10. The electrical connector as claimed in claim 9, wherein the outer shield comprises a front shield and a rear shield locked with each other.

11. The electrical connector as claimed in claim 9, further comprising a grounding tab received in the dielectric housing, and wherein the grounding tab comprises a contact portion connecting with the inner shield and a soldering portion extending beyond the dielectric housing.

12. An electrical connector assembly comprising:

a dielectric housing;

a plurality of first and second terminals received in the dielectric housing, each terminal comprising a contact portion adapted for engaging with a complementary connector and an intermediate portion extending from the contact portion; and a spacer assembled onto the dielectric housing, the intermediate portions of the first terminals being insert-molded in the spacer while the intermediate portions of the second terminals abutting thereagainst on an outer surface of the spacer;

wherein the dielectric housing defines a plurality of passageways and wherein the intermediate portion of each second terminal is received in a corresponding passageway.

* * * * *